United States Patent [19]

Noguchi

[11] Patent Number: 4,621,883

[45] Date of Patent: Nov. 11, 1986

[54] ELECTRICAL CONNECTOR ASSEMBLY

[75] Inventor: Masaro Noguchi, Sagamihara, Japan

[73] Assignee: AMP Incorporated, Harrisburg, Pa.

[21] Appl. No.: 824,295

[22] Filed: Jan. 27, 1986

Related U.S. Application Data

[63] Continuation of Ser. No. 484,053, Apr. 11, 1983, abandoned.

[30] Foreign Application Priority Data

Apr. 14, 1982 [GB] United Kingdom ..... 8210774

[51] Int. Cl.[4] ..... H01R 11/00

[52] U.S. Cl. ..... 339/60 M; 339/94 M

[58] Field of Search ..... 339/60 R, 60 C, 60 M, 339/94 R, 94 C, 94 M

[56] References Cited

U.S. PATENT DOCUMENTS 3,077,572 2/1963 Zimmerman, Jr. ..... 339/217
3,937,545 2/1976 Cairns et al. ..... 339/60 R
3,994,553 11/1976 Kornick ..... 339/60 R
4,090,759 1/1978 Herrmann ..... 339/60 M
4,311,355 1/1982 Plyler et al. ..... 339/94 R

FOREIGN PATENT DOCUMENTS 2347971 4/1974 Fed. Rep. of Germany ... 339/94 M
1314138 11/1962 France ..... 339/94 M

*Primary Examiner*—Gil Weidenfeld
*Assistant Examiner*—Paula A. Austin
*Attorney, Agent, or Firm*—Robert W. J. Usher

[57] ABSTRACT

A sealed electrical connector assembly comprises two housings (1, 2) which are mateable with a sealing gasket (11) between them, the gasket (11) being located in a blind cavity (6) in one housing (1) and being compressed between the housings (1, 2) and perpendicularly thereto between a projecting shroud (8) on the other housing, which is received in the blind cavity (6), and a wall (4) of the blind cavity (6), whereby a large area of sealing is obtained.

5 Claims, 5 Drawing Figures

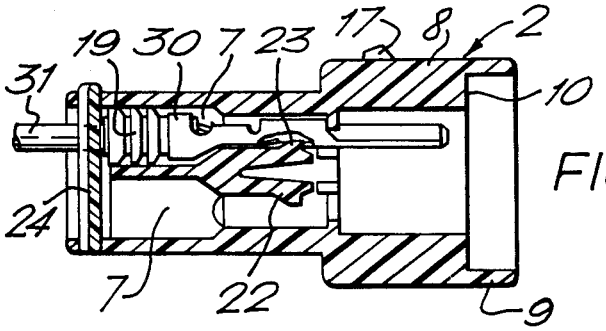
FIG.3.
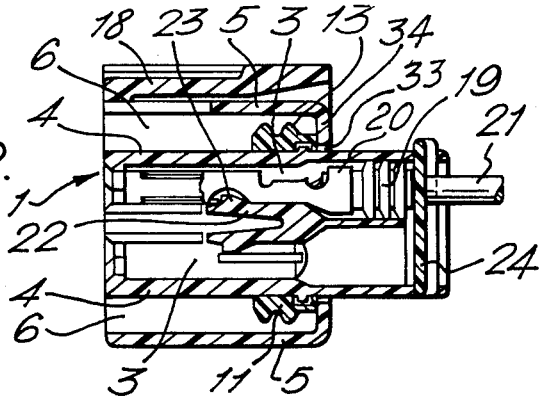
FIG.2.
FIG.4.
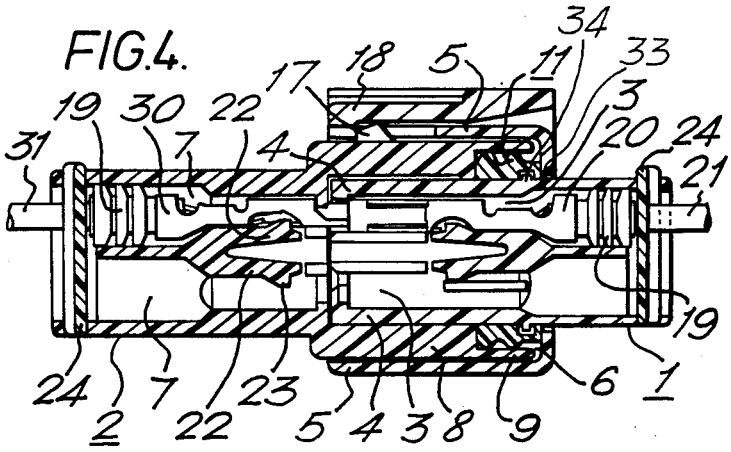

ELECTRICAL CONNECTOR ASSEMBLY

This application is a continuation of application Ser. No. 484,053, filed April 1, 1983, now abandoned.

This invention relates to an electrical connector assembly, and particularly to an electrical connector assembly comprising two mateable housings and means to seal the interface between the two housings when mated against the ingress of moisture.

Such sealed connector assemblies find use in automobiles at positions where the splashing of water onto the assemblies could, if unsealed assemblies were used, result in short circuit problems.

According to this invention there is provided an electrical connector assembly comprising first and second mateable housings and means to seal the interface between the housings when mated, against the ingress of moisture, in which the sealing means compirses a resilient gasket received in a blind cavity formed by inner and outer walls of the first housing, the second housing having a projecting shroud receivable in the cavity in the first housing with a projecting wall of the shroud received between the outer wall of the cavity and the gasket, and a further wall of the shroud serving to compress the gasket in the direction of insertion of the shroud into the cavity, such compression serving to urge the gasket into sealing engagement with the inner wall of the cavity and the projecting wall of the shroud.

An electrical connector assembly according to this invention will now be described by way of example with reference to the drawings, in which:

FIG. 2 is a longitudinal sectional view of one housing of the assembly in the assembled state;

FIG. 3 is a view similar to FIG. 2 but of the other housing of the assembly;

FIG. 4 is a view of the housings of FIGS. 2 and 3 in a mated condition.

Figure 1:
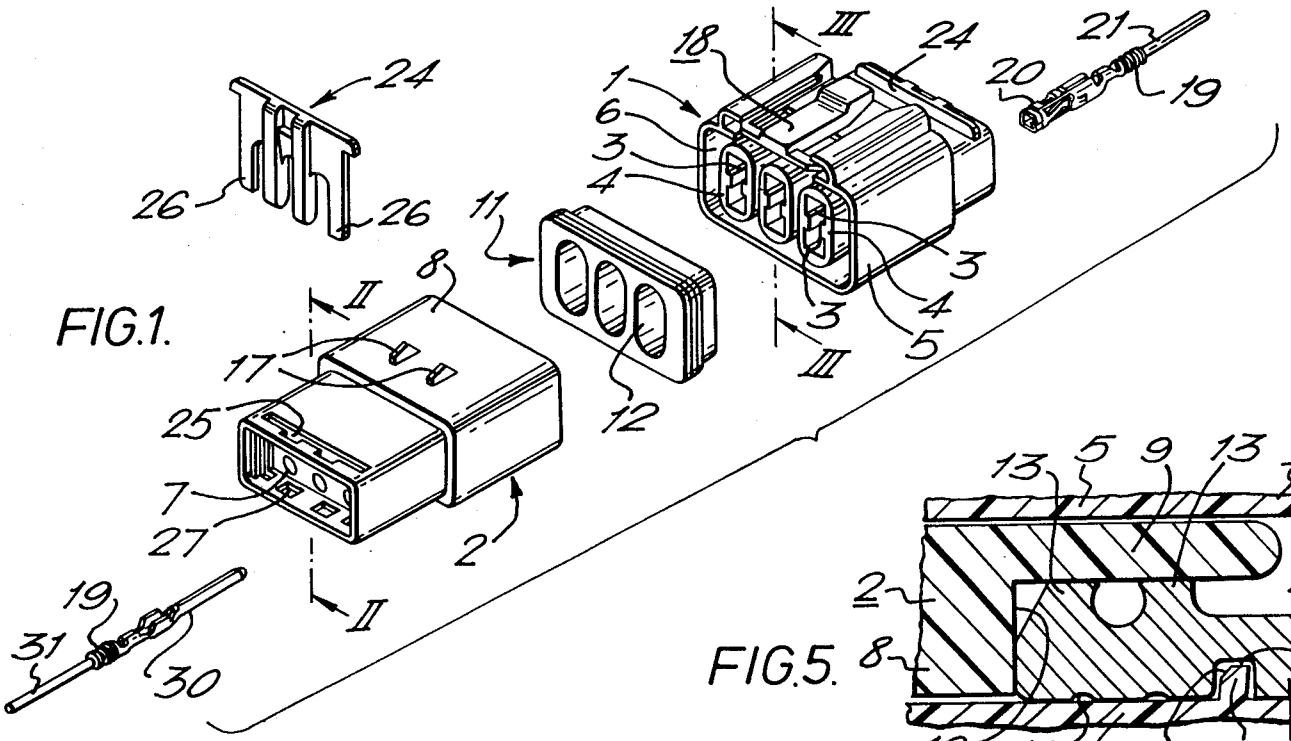
FIG. 1 is an exploded perspective view of the assembly.

The assembly shown in FIG. 1 comprises first and second housings 1 and 2 each moulded from an electrically insulating plastics material.

The first housing 1 is formed with three pairs of through cavities 3 each to receive and retain a female contact 20 terminating an insulated conductor 21. Each pair of cavities 3 is defined by an individual annular inner wall 4 of the housing 1, the three inner walls 4 being surrounded by a single outer wall 5 which with the inner walls 4 defines a annular blind cavity 6 which surrounds the inner walls 4 and extends between them.

The second housing member 2 is formed with six through cavities 7 each to receive and retain a male contact 30 terminating an insulated conductor 31. Mating portions of the male contacts 30 project out of the cavities 7, and are surrounded by a shroud 8 having at its free end a projecting wall 9 of less thickness than the remainder of the wall of the shroud 8, the remainder thus terminating in a wall 10 facing the free end of the shroud 8.

Figure 5:
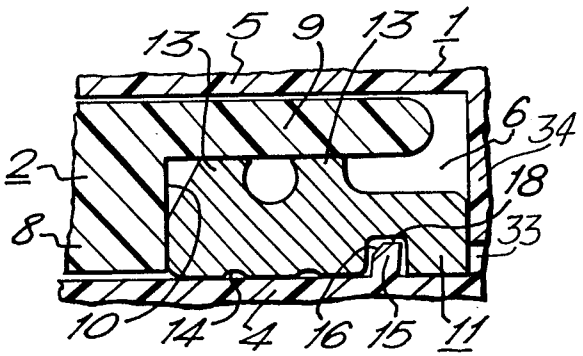
FIG. 5 is a sectional fragmentary view showing the area of sealing in the assembly.

As shown by FIGS. 4 and 5, the shroud 8 is sized and arranged to be received in the cavity 6 in the housing 1 about the inner walls 4 when the housings 1 and 2 are mated to mate the contacts 20 and 30 carried by the housings 1 and 2.

The assembly also includes a resilient sealing gasket 11 sized and adapted to be received in the cavity 6 in the housing 1, the gasket 11 having three through holes 12 each to receive a respective inner wall 4 of the housing 1.

As best seen in FIG. 5, the surfaces of the gasket 11 facing each inner wall 4 of the housing 1 are each formed with an annular groove 18 which receives annularly extending ribs 15 on the opposed inner wall 4 thereby to secure the gasket 11 in the cavity 6 in the housing 1. Apertures 33 are formed in a base wall 34 of the cavity 6 in axial alignment with respective ribs.

The outer surface of the gasket 11 is formed with two initially rounded peripheral ribs 13 while the surfaces of the holes 12, which face the inner walls 4, are each formed with two arcuate cross-section peripheral grooves 14 (FIG. 5).

On mating of the housings 1 and 2, with the gasket 11 mounted in the cavity 6 as shown in FIG. 2, the wall 10 of the shroud 8 on the housing 3 engages the gasket 11 and compresses it in the direction of insertion of the shroud 8 into cavity 6. The projecting wall 9 of the shroud 8 is received between the ribs 13 on the gasket 11 and the outer wall 5 of the housing 1, as best seen in FIG. 5. The compression of the gasket 11 by the wall 10 of the shroud 8 urges the gasket 11 into sealing engagement with the inner walls 4 of the cavity 6 and the projecting wall 9 of the shroud 8, this causing compression of the ribs 13 as shown in FIG. 5.

The gasket 11 thus serves to seal the interface between the housings 1 and 2 when mated as shown in FIG. 4, by preventing any moisture which enters between the outer wall 5 of the housing 1 and the shroud 8 of the housing 2 from passing into the contact-containing cavities 3 and 7 of the housings 1 and 2.

As clearly shown in FIG. 5 the ribs 15 on the inner walls 4 of the housing 1 have a chamfered corner 16 facing the open end of the cavity 6. This chamfered corner 16 serves to facilitate insertion of the gasket 11 into the cavity 6, the gasket 11 simply being pushed into the cavity 6 with the chamfered corners 16 serving to lift the leading end of the gasket 11 over the ribs 15 until the ribs 15 become received in the grooves 18 in the gasket 11.

The housings 1 and 2 are provided with co-operating latching means which serve to hold the housings 1 and 2 together in the mated condition with the gasket 11 in its compressed, sealing condition. These latching means comprise a pair of ramps 17 on one side of the housing 2 and a co-operating arm arrangement 18 on the housing 1. Such a latching means is described in U.S. Pat. No. 4,272,145 and will not therefore be described in detail herein. The essential difference is that in the assembly disclosed in the U.S. patent there is only a single ramp which is used by the arm arrangement as a pivot to effect release of the latching between the housings, whereas in the present assembly the arm arrangement pivots on the housing carrying the arm arrangement to effect release of the latching.

At the conductor-entry end each housing 1 or 2 is sealed by ribbed plug members 19 one of which is crimped into each conductor 21 or 31 together with the associated contact 20 or 30 so as to be received in the cavity 3 or 7 receiving the contact 20 or 30 to seal the conductor-entry end of each cavity 3 or 7 against the ingress of moisture.

Each contact 20 or 30 is secured in its associated cavity 3 or 7 in housing 1 or 2 by means of a resilient latch arm 22 formed in a wall of the cavity 3 or 7, the latch arm 22 having a projection 23 at its free end, which engages in an aperture in the associated contact 20 or 30. A second means of securing the contacts 20 or 30 in their cavities 3 or 7 is provided by a fingered plate 24 which is received and becomes latched in a slot 25 (FIG. 1) in one wall of the housing 1 or 2 with the free ends of the fingers 26 of the plate 24 being received in holes 27 in the opposite wall of the housing 1 or 2. The spacing between the fingers 26 of the plate 24 is just sufficient to pass the conductors 21 or 31 but will not pass the contacts 20 or 30 or the sealing plug members 19 whereby with the plate 24 in place the contacts 20 or 30, and the plug members 19 are secured in their cavities 3 or 7.

What is claimed is:

1. An electrical connector assembly comprising first and second matable rigid housings and sealing means, the first housing being moulded in one piece of plastics material and including inner and outer walls having surfaces extending in the mating direction and joined by a base wall defining between them an annular cavity, the sealing means comprising a resilient gasket received in the annular cavity, the second housing including a projecting shroud with a projecting wall of the shroud having a surface extending in the mating direction received in the cavity between the outer wall of the cavity and the gasket, so that the gasket is in sealing engagement with the surface of the inner wall of the cavity and the surface of the projecting wall of the shroud, a surface of the gasket facing the surface of the inner wall of the cavity being formed with a groove and being formed with a rib outstanding from the surface of the inner wall of the cavity which rib is received in the groove thereby to secure the gasket in the cavity, an aperture being formed in the base wall of the cavity in axial alignment with the rib.

2. An electrical connector assembly according to claim 1 in which the groove is annular and the inner wall of the cavity is formed at annularly spaced intervals with a plurality of ribs received in the annular groove, apertures being formed in the base wall of the cavity in axial alignment with respective ribs.

3. An electrical connector assembly according to claim 1 in which the surface of the gasket facing the outer wall of the cavity is formed with a plurality of annular ribs which sealingly engage the surface of the projecting wall of the shroud which extends in the mating direction, when the first and second housings are mated.

4. An electrical connector according to claim 1 in which the shroud is provided with a further wall having a surface extending transversely of the mating direction serving to compress the gasket in the direction of insertion of the shroud into the cavity, such compression serving to urge the gasket into sealing engagement with the surfaces of the inner wall of the cavity and projecting wall of the shroud which extend in the mating direction.

5. An electrical connector assembly according to claim 4 in which the surface of the gasket facing the outer wall of the cavity is formed with a plurality of annular ribs which sealingly engage the surface of the projecting wall of the shroud which extends in the mating direction, when the first and second housings are mated to compress the gasket.

* * * * *